US005142798A

United States Patent [19]

Kaufman et al.

[11] Patent Number: 5,142,798

[45] Date of Patent: Sep. 1, 1992

[54] DOWNHILL SKI BOOT ASSEMBLY

[75] Inventors: William H. Kaufman; Frederick A. Harrison, both of Kitchener; Claude J. Gidman, Toronto; Gerald Beekenkamp, Paris, all of Canada

[73] Assignee: William H. Kaufman Inc., Kitchener, Canada

[21] Appl. No.: 722,221

[22] Filed: Jun. 27, 1991

Related U.S. Application Data

[63] Continuation-in-part of Ser. No. 647,973, Jan. 30, 1991, abandoned, which is a continuation-in-part of Ser. No. 549,920, Jul. 9, 1990, Pat. No. 5,068,984.

[51] Int. Cl.[5] ..... A43B 5/04

[52] U.S. Cl. ..... 36/117; 36/120

[58] Field of Search ..... 36/114, 117–121

[56] References Cited

U.S. PATENT DOCUMENTS

| | | | |
|---|---|---|---|
| 3,636,642 | 1/1972 | Walther | 36/2.5 |
| 3,645,017 | 2/1972 | Hickmann | 36/120 |
| 3,793,747 | 2/1974 | Mochizuki | 36/2.5 |
| 4,299,037 | 11/1981 | Carey | 36/7.6 |
| 4,367,885 | 1/1983 | Ramer | 36/121 X |
| 4,570,363 | 2/1986 | Annovi | 36/117 |
| 4,677,769 | 7/1987 | Ahmad et al. | 36/117 |
| 4,839,972 | 6/1989 | Pack et al. | 36/117 |
| 4,959,912 | 10/1990 | Kaufman et al. | 36/117 |
| 4,979,319 | 12/1990 | Hayes | 36/117 |

FOREIGN PATENT DOCUMENTS

| | | |
|---|---|---|
| 3821053 | 1/1989 | Fed. Rep. of Germany . |
| 2544969 | 11/1984 | France . |

OTHER PUBLICATIONS

European Patent Application 0020315 A1, Erik Trell, Dec. 10, 1980.

*Primary Examiner*—Paul T. Sewell
*Assistant Examiner*—Ted Kavanaugh
*Attorney, Agent, or Firm*—Ridout & Maybee

[57] ABSTRACT

A downhill ski boot assembly combines a flexible walking boot with a boot brace insertable into a standard ski binding to provide a skier with the control and feel of a conventional hard ski boot. The boot brace has a sole plate insertable into the ski binding, a toe cap and boot restraining means for urging the sole of the boot against the sole plate. Lower leg support is provided by the brace by means of upright supports which are preferably inner and outer lateral struts extending from the sole plate to a shin or calf piece. The lower leg support has a spring biased pivot adjacent the ankle region which allows the skier to move his lower leg forward from the ankle against a biasing force.

14 Claims, 8 Drawing Sheets

DOWNHILL SKI BOOT ASSEMBLY

This application is a continuation-in-part of Ser. No. 07/647,973 filed Jan. 30, 1991 now abandoned, which is a continuation-in-part of Ser. No. 07/549,920 filed Jul. 9, 1990 now U.S. Pat. No. 5,068,984.

The invention is a ski boot assembly for a downhill ski and binding. The assembly comprises a boot brace for receiving and holding a soft boot in a conventional downhill ski binding. The boot brace enables the skier to control the ski in the normal way, and the soft boot allows the skier to walk normally when he is not skiing.

It is well recognized that the standard hard shell downhill ski boot is very awkward and uncomfortable to walk in. A number of prior attempts to utilize a reasonably comfortable soft walking boot in combination with support means for use in downhill skiing have suffered from serious shortcomings. Prior devices have predominantly attempted to provide control for the skier through the use of a strut or the like extending from the skier's calf either along the side of the leg or along the back of the leg to the ski binding. These prior devices usually did not provide the skier with a sufficient degree of control over the ski, or they were awkward to use, being cumbersome or complex to attach and adjust. Often the prior devices proved to be of insufficient strength to survive normal downhill skiing maneuvers or mishaps.

The present invention overcomes the disadvantages of prior devices and satisfies a long felt need for a ski boot assembly which may be used with a walking boot. Accordingly, the invention provides a downhill ski boot assembly comprising the combination of a boot brace and a flexible walking boot adapted to be held in the brace and to be releasable from it.

The boot brace has a rigid sole plate which is releasably securable in a downhill ski binding. Forefoot receiving means is attached to and extends over the forward portion of the sole plate. Preferably, the forefoot receiving means is a curved plastic molded toe cap into which the toe of the flexible boot can be inserted and held against substantial movement.

The bracing structure of the boot brace of the invention comprises rigid leg support means which extend upwardly from the sole plate to engage the leg shaft of the boot. Preferably, the leg support means comprise inner and outer lateral struts which extend upwardly from the sole plate to a curved calf or shin piece which receives the leg shaft of the boot. Each strut is pivotally hinged approximately adjacent the skier's ankle so that the skier may pivot his leg forwardly from the ankle when skiing. The struts provide lateral support for the skier's leg so that he may exert a satisfactory degree of control over the ski during skiing. At least one of the pivot hinges in the leg support means is spring biased to provide an elastic resistance to the forward rotational force of the skier's lower leg. This resistance is akin to that provided by a standard ski boot. The spring biasing for the strut pivot is preferably provided by a rubber or other elastomeric spring unit which can be modified to fit the individual needs of the skier.

BRIEF DESCRIPTION OF THE DRAWINGS

As shown in FIG. 1, the preferred boot assembly of the invention comprises a boot brace 10 into which a flexible boot 12 may be releasably inserted. The boot 12 is specially designed to fit into the structure of the boot brace 10, but the boot 12 is not of a radically different construction than that of many ordinary winter boots, the principal difference being that the boot 12 has a heel 13 which is specially structured to coact with the brace 10.

Figure 1:
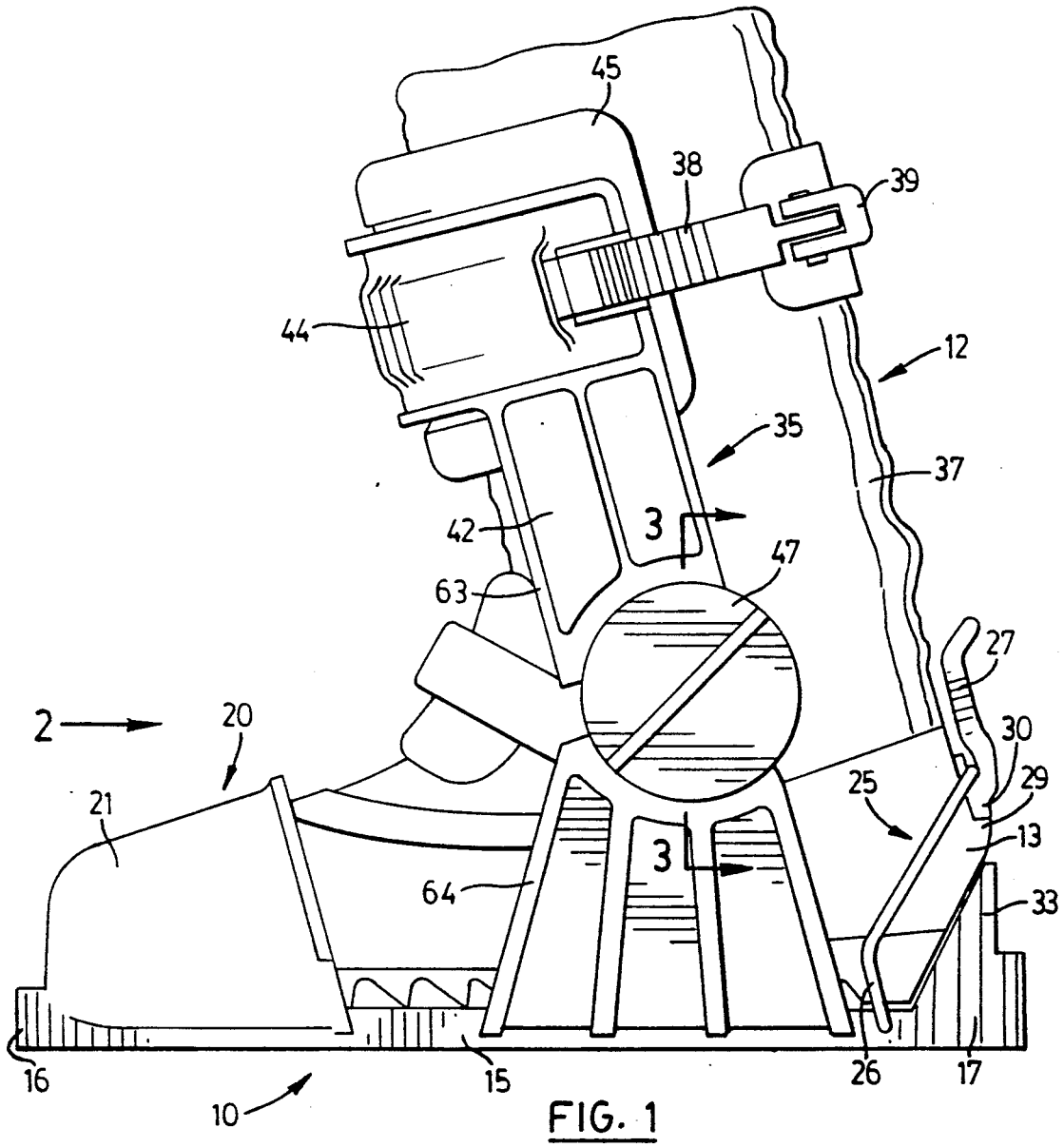
FIG. 1 is a side elevation of a preferred boot assembly of the invention.

The boot brace 10 has an elongate sole plate 15 which is preferably made of a moldable thermoplastic. The sole plate 15 has toe 16 and heel 17 portions shaped to fit into and to be releasably secured by a standard downhill ski binding.

A forefoot receiving means 20 for accepting and holding the toe portion of the boot 12 is attached to the forward portion of the sole plate 15. Preferably, the receiving means 20 is a curved toe cap 21 molded integrally with the sole plate 15. The purpose of the forefoot receiving means 20 is to provide a releasable securement of the toe portion of the boot 12 in the boot brace 10. It will be apparent to the skilled person that this objective may be achieved using various structures for the forefoot receiving means 20.

A heel hold down means 25 is provided at the rear portion of the sole plate 15 for releasably securing the heel 13 of the boot 12 in the boot brace 10. In this embodiment, the preferred structure of the heel hold down means 25 comprises a wire loop 26 pivotally attached to the sole plate 15. The loop 26 has a latch 27, preferably of the eccentric or over centre type, which may engage a latch receiving structure 29 formed in the heel portion 13 of the boot 12. The latch receiving structure 29 may be a simple flange or notched area at the back of the boot 12 or a slot may be formed in the boot 12 into which a tongue 30 of the latch 27 may be inserted and secured. The wire loop 26 is shaped to hold the heel 13 of the boot 12 in the brace 10 under tension. Preferably, the heel portion 17 of the sole plate 15 has an upright heel stop 33 which is shaped to receive the boot heel 13 and prevent the boot 12 from moving rearwardly when secured in the brace 10. Other heel hold down means within the scope of the invention will be apparent to the skilled person.

An important aspect of a downhill ski boot is the ability of the boot to coact with the skier's leg as well as his foot to exert control over the ski. This leg control is provided by the stiffness of a conventional ski boot which extends along the skier's lower leg.

Figure 2:
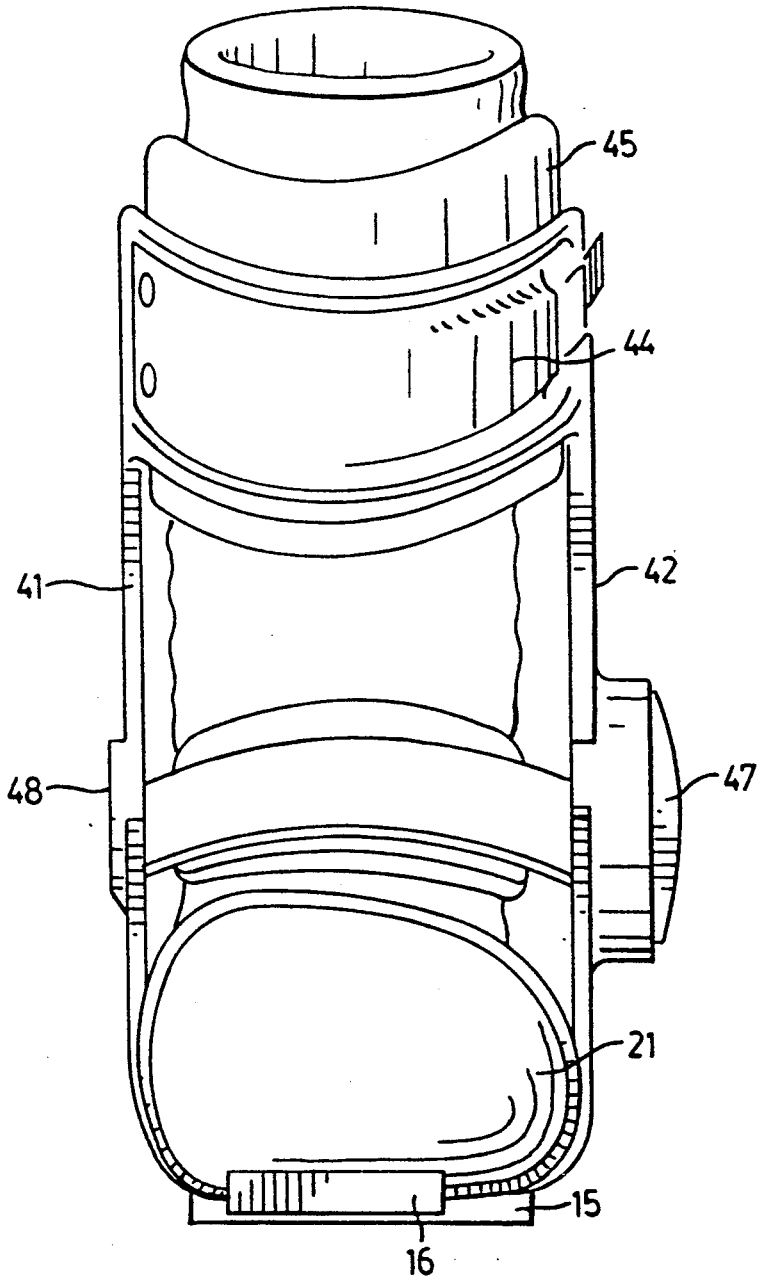
FIG. 2 is a front elevation of the assembly shown in FIG. 1.

The invention provides an ability, similar to that of a conventional ski boot, for the skier to exert control over the ski by moving his lower leg in relation to structural elements. In conventional ski boots, the ski boot material itself provides the degree of flex or give to enable the skier to exert control over the ski. The approach taken by the present invention differs conceptually from such prior ski boots in that all structural elements of the boot brace 10 are rigid and control is exerted by the skier through a spring biased pivot as described below. In the preferred embodiment shown in FIGS. 1 and 2, these structural elements comprise leg support means 35 which extend upwardly from the sole plate 15 along the inner and outer sides of the boot 12. The leg support means 35 are releasably securable about the leg shaft 37 of the boot 12 preferably by means of a strap 38 and buckle 39. The leg support means 35 preferably comprise inner and outer lateral struts 41 and 42 which are attached at their lower ends to the sole plate 15, and at their upper ends are joined to a curved shin piece 44. The struts 41 and 42 and shin piece 44 are all made of a rigid material, preferably, a thermoplastic. Preferably, a pad 45 is provided along the inner surface of the shin piece 44 to cushion the skier's shin from the rigid shin piece 44. At least one strap 38 and a buckle 39 extend from the shin piece 44 to releasably secure it about the upper portion of the boot 12.

The leg support means 35 also has a spring biased pivot 47 adjacent the ankle region of the boot 12. This pivot 47 allows the skier to move his lower leg slightly forward by bending at the ankle, thereby allowing the skier to readily adjust his weight over the ski during skiing. The spring biased pivot 47 provides forward resistance to the lower leg of the skier in a manner similar to that encountered in a conventional ski boot. While a spring biased pivot 47 may be incorporated into each strut 41 and 42, it is preferred to have such a pivot 47 in the outer strut 42 with the inner strut 41 having a non-biased pivot 48. A preferred spring biased pivot 47 is shown in FIGS. 3-6 and is of the rubber spring type.

Figure 3:
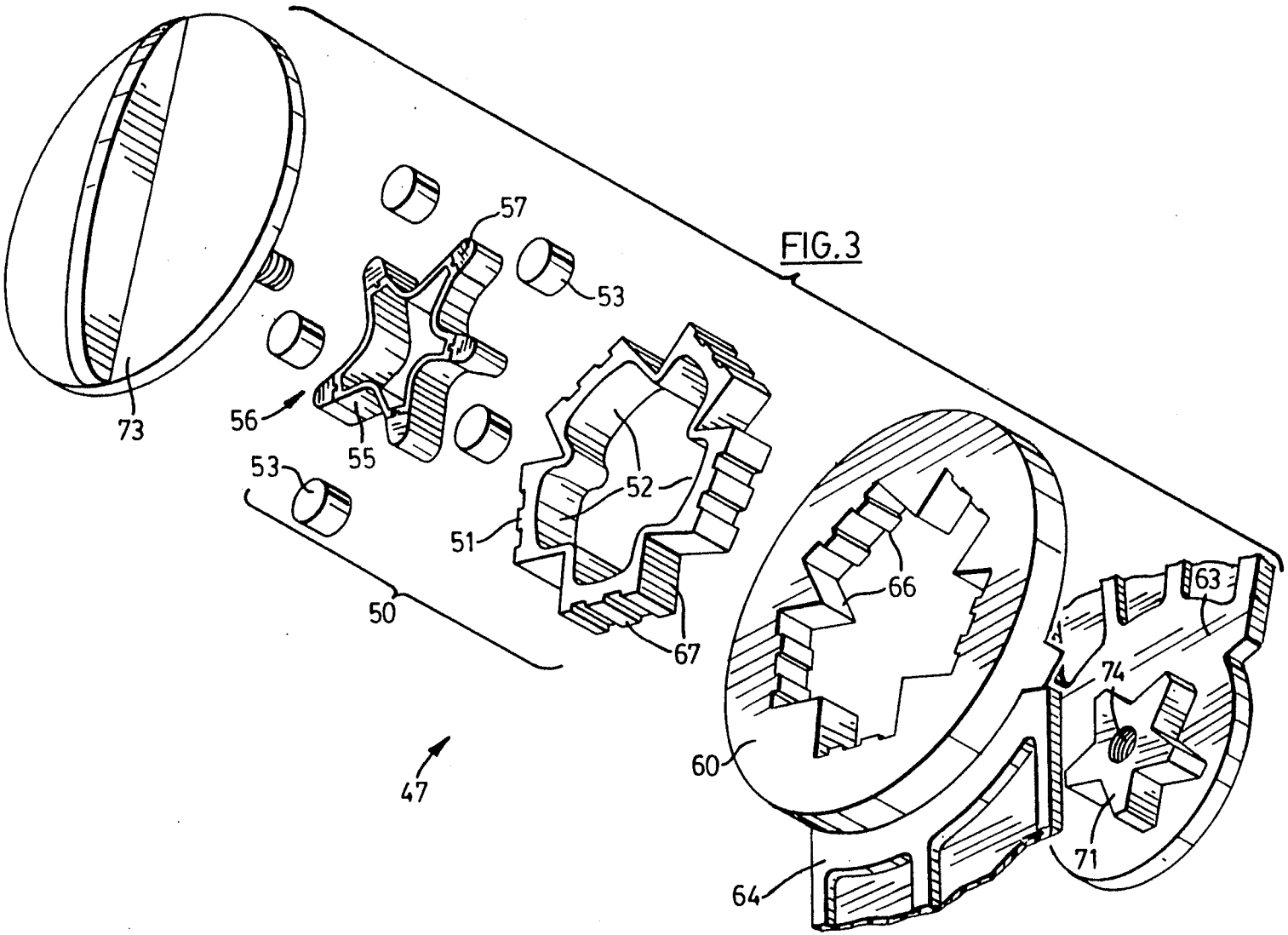
FIG. 3 is an exploded detail of a preferred spring biasing means for a strut pivot.

Referring to FIG. 3, the preferred spring biased pivot 47 comprises a cassette 50 having an outer frame 51 defining a plurality of inner spaces 52 shaped to receive an elastic member 53 and a movable part such as an arm 55 of an insert 56. While the star shaped insert 56 shown in FIGS. 3-6 is preferred, clearly the shapes of the rubber spring components may vary and still perform the same function.

The cassette 50 is securable against rotation of the frame 51 by insertion into a cassette holder 60 attached to a strut part 42. As shown in FIG. 3, the strut 42 is divided into an upper part 63 and a lower part 64 with the cassette holder 60 being attached to the lower part 64. The holder 60 preferably has a plurality of inner surfaces 66 which coact with corresponding outer surfaces 67 of the cassette frame 51. The holder 60 is structured to prevent rotation of the frame 51 but to allow the cassette 50 to be easily inserted or removed from it. Indexing means may be provided in the structure of the holder 60 to orient the cassette frame 51 in the holder 60 so that the upper strut part 63 is at a desired angle to the lower strut part 64 when the spring biased pivot 47 is assembled. For example, an expert skier may wish to have a more pronounced forward pitch for the strut 42 about the pivot 47 than would a novice skier, who would prefer a more upright feel for skiing on fairly gentle slopes.

An actuator 71 for the movable insert 56 is affixed to the other strut part 42, which according to the preferred embodiment shown in FIG. 3 is the upper part 63. The actuator 71 is shaped to fit within the insert 56 and to cause the arms 55 of the insert 56 to move against the elastic members 53 when the upper strut part 63 is rotated forwardly by the skier's leg pressure on the shin part 44. The operation of the spring biased pivot 47 is shown in FIGS. 4-6.

Figure 4:
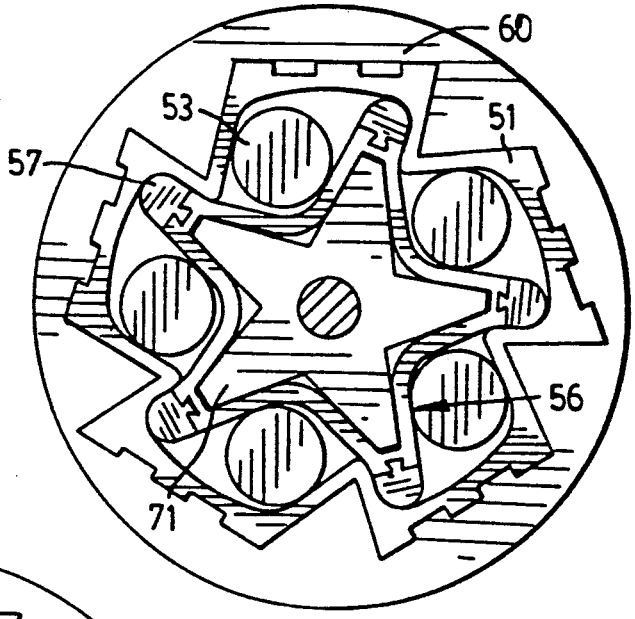
FIGS. 4–6 are side elevations of details of the preferred spring biasing means illustrating its operation.

In FIG. 4, the actuator 71 is exerting no rotational force on the insert 56, so the elastic members 53 are not compressed. In FIG. 5, forward leg pressure exerted by the skier on the shin part 44 has caused the actuator 71 to move the insert 56 so that the arms 55 of the insert 56 have begun to compress the elastic members 53. The elastic members 53 in turn exert a counter force on the insert 56 so that the skier experiences a spring resistance to his leg pressure. FIG. 6 shows near complete compression of the elastic members 53 by the rotational movement of the insert 56, thus representing the approximate limit of movement enabled by the structure.

Figure 5:
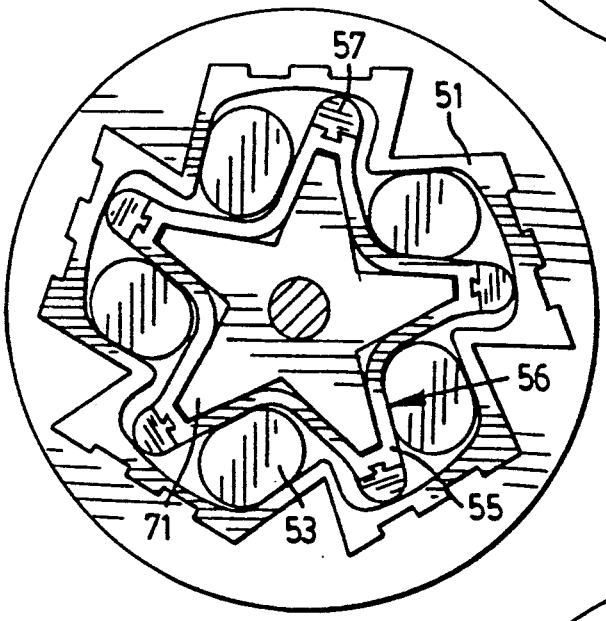
Figure 6:
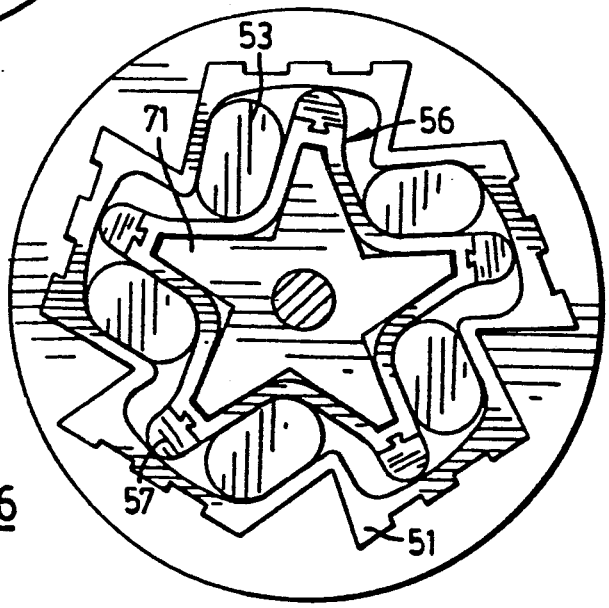

As shown in FIGS. 4-6, the arms 55 of the insert 56 preferably are provided with tips 57 to promote smooth movement of the insert 56 within the frame 51. Preferably, the frame 51 and insert 56 are made of a metal such as aluminum, and the tips 57 are then preferably of a plastic such as nylon.

The assembly of components for the spring biased pivot 47 is held together preferably by a cap screw 73 which is screwed into the threaded core 74 of the actuator 71. Clearly, various other means may be used to hold the components of the spring biased pivot 47 together during operation.

The preferred structure for the spring biased pivot 47 described herein has the advantage of employing a cassette 50 equipped with elastic members 53 tailored to the body weight and skiing needs of the individual skier. By varying the elastic properties of the rubber or other material used for the elastic members 53, the pivot 47 can be provided with the appropriate degree of biasing to suit the needs of the individual skier.

While the spring biased pivot 47 as described is preferred, the skilled person will appreciate that the invention includes all variants and equivalents providing a spring biasing adjacent an ankle pivot of the boot brace 10. In particular, the spring bias means of the pivot 47 comprise inner and outer parts which coact with at least one elastomeric member positioned between them. The elastomeric member provides an elastomeric force acting on the strut parts 63 and 64 through the inner and outer parts of the spring bias means when such parts are rotated relative to one another.

Figure 7:
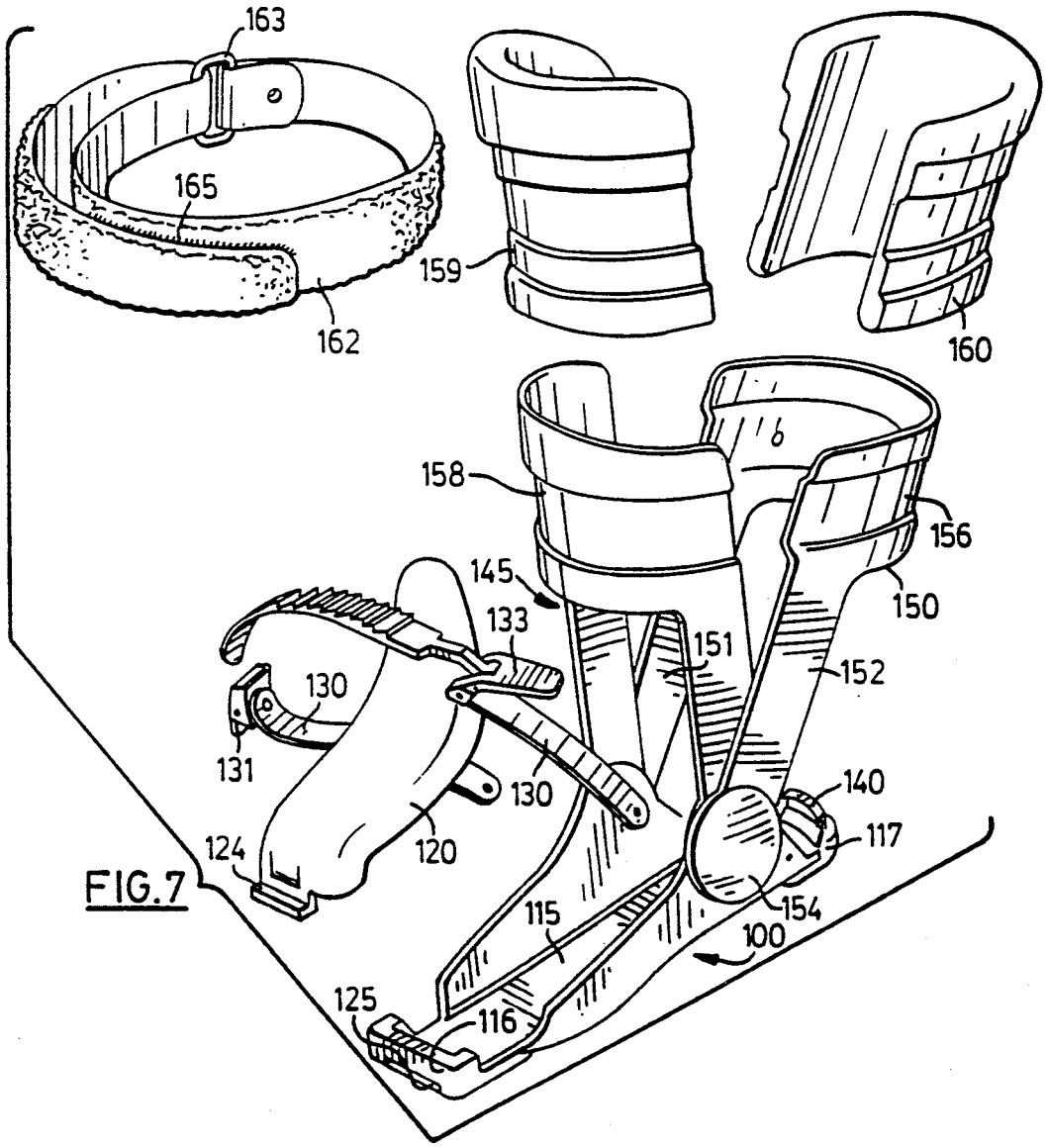
FIG. 7 is a perspective, partially exploded view of a further embodiment of the invention showing alternative structures for the forefoot receiving means and heel hold down means as well as the addition of a calf brace.

A further embodiment of the invention is shown in FIG. 7. The boot brace 100 shown in FIG. 7 has a sole plate 115 with toe 116 and heel 117 portions shaped to fit into and to be releasably secured by a standard downhill ski binding.

A forefoot receiving means 120 for accepting and holding the toe and forefoot, or vamp, portion of the boot 112 (FIG. 8) is in pivotal relation to the sole plate 115. Preferably, the forefoot receiving means 120 is a thermoplastic part shaped to cover the toe and vamp portions of the boot 112, and is preferably pivotally attached at the toe 116 of the sole plate 115 so that the forefoot receiving means 120 can pivot upwardly and forwardly of the sole plate 115 to allow easy insertion of the boot 112 into the brace 100. The boot 112 has a sole 113 with a peripheral upper flange 114. The forefoot receiving means 120 preferably has a rearwardly extending lip 122 at the front thereof for engaging the sole flange 114 at the toe of the boot 112 (FIG. 8), thereby aiding in holding the toe portion of the boot 112 against the sole plate 115.

Figure 8:
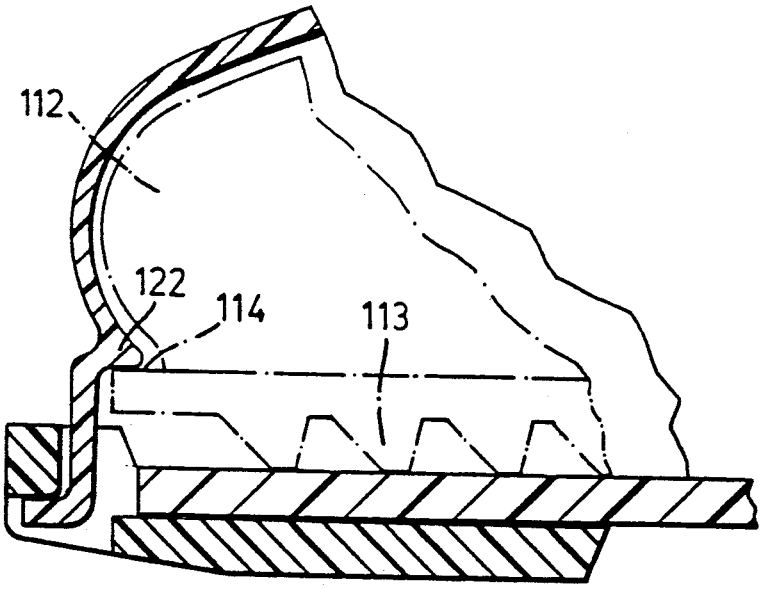
FIG. 8 is a detail cross section of forefoot receiving means of FIG. 7 showing a preferred mode of operation in coacting with the sole of a boot.

As the skilled person will appreciate, the manner of pivotal attachment of the forefoot receiving means 120 to the toe 116 of the sole plate 115 can vary considerably within the scope of the invention. It is, however, preferred that the forefoot receiving means 120 be attached to the sole plate 115 and not be a separate piece which might be lost or misplaced. As shown in FIG. 8, the forefoot receiving means 120 preferably has a forwardly extending tongue 124 engageable in a slot 125 formed in the front of the toe 116 of the sole plate 115. Pins or other securement means (not shown) are provided to attach the forefoot receiving means 120 to the toe part 116 without unduly inhibiting the forward pivoting of the forefoot receiving means 120.

The forefoot receiving means 120 is secured about the forefoot of a boot 112 inserted in the brace 100 by means of a strap 130 attached to the brace 100 near the heel portion 117 of the sole plate 115. Preferably, the strap 130 has two pieces which are joined by a buckle 131. Additionally, it is preferred to include an over centre latch 133 in the strap 130 to provide a means for final tightening of the strap 130 just prior to making a ski run.

A heel hold down means 140 is incorporated preferably as an integral part of the heel portion 117 of the sole plate 115. The heel hold down means 140 is a hook which preferably extends substantially along the rear of the upper peripheral flange 114 of the boot sole 113. The forefoot receiving means 120 cooperates with the heel hold down means 140 to capture and hold the sole 113 of the boot 112 in the brace 100.

Leg support means 145 of this embodiment correspond to the leg support means 35 described above in reference to FIGS. 1–6. The embodiment shown in FIG. 7, however, includes the additional feature of a calf brace 150. The calf brace 150 has inner and outer lateral struts 151 and 152 extending upwardly from a pivot connection 154 about the ankle area to a rearwardly convexly curved calf piece 156. The calf brace is freely pivotable downwardly and rearwardly of the boot brace 100 to enable unrestricted entry and removal of the boot 112. Both the shin piece 158 and the calf piece 156 preferably are equipped with pads 159 and 160 respectively, and the leg support means 145 and calf brace 150 are secured about the leg shaft of the boot 112 by means of a strap 162 preferably equipped with a rectangular ring 163, and VELCRO (trade-mark) means 165 for securing the strap end.

Figure 9:
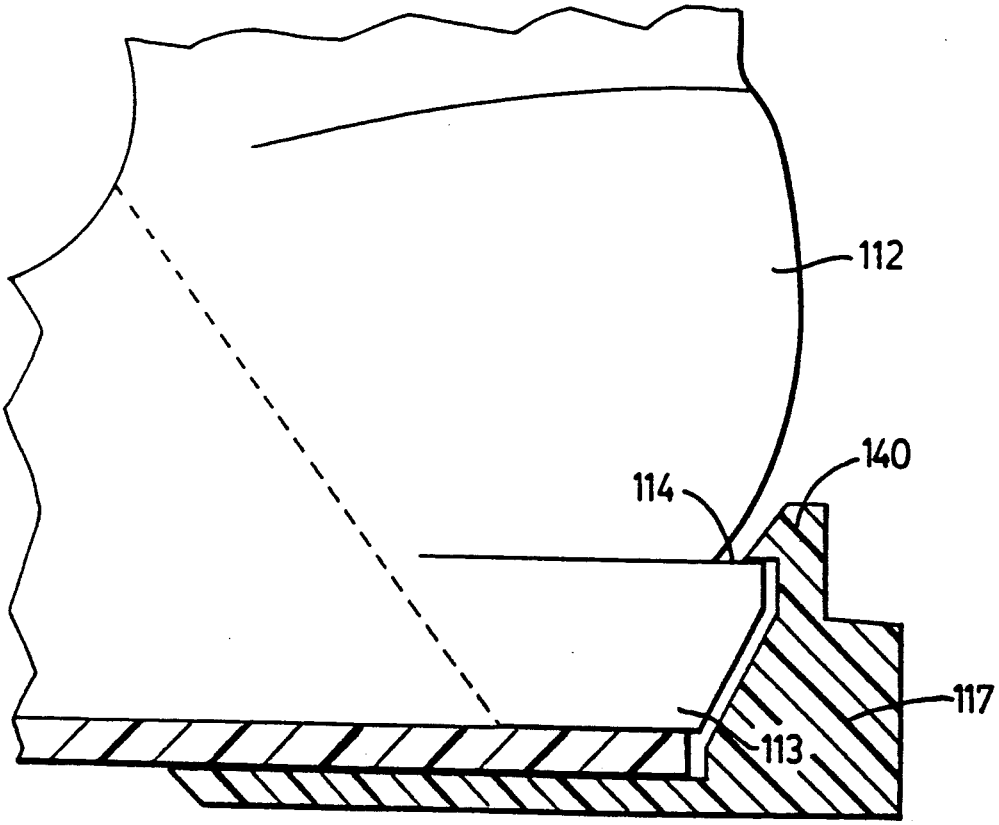
FIG. 9 is a detail cross section showing the engagement of the heel hold down means of FIG. 7 with the sole of a boot.

In operation, the embodiment shown in FIGS. 7–9 is used as follows. The calf brace 150 is lowered so that the calf piece 156 extends rearward of the heel portion 117. The forefoot receiving means 120 is pivoted forwardly, and the skier's booted foot is inserted into the boot brace 100 so that the sole flange 114 engages the heel hold down hook 140. With the boot sole 113 flat against the sole plate 115, the forefoot receiving means 120 is pivoted rearwardly and downwardly and secured in place over the toe and vamp of the boot 112 by the strap 130. The calf brace 150 is then raised to position and secured about the skier's leg using the strap 162.

The forefoot receiving means 120 and heel hold down means 140 cooperate to releasably secure the boot 112 in the brace 100, while the leg support means 145 and the calf brace 150 cooperate to provide the skier with lower leg control over the ski.

Figure 10:
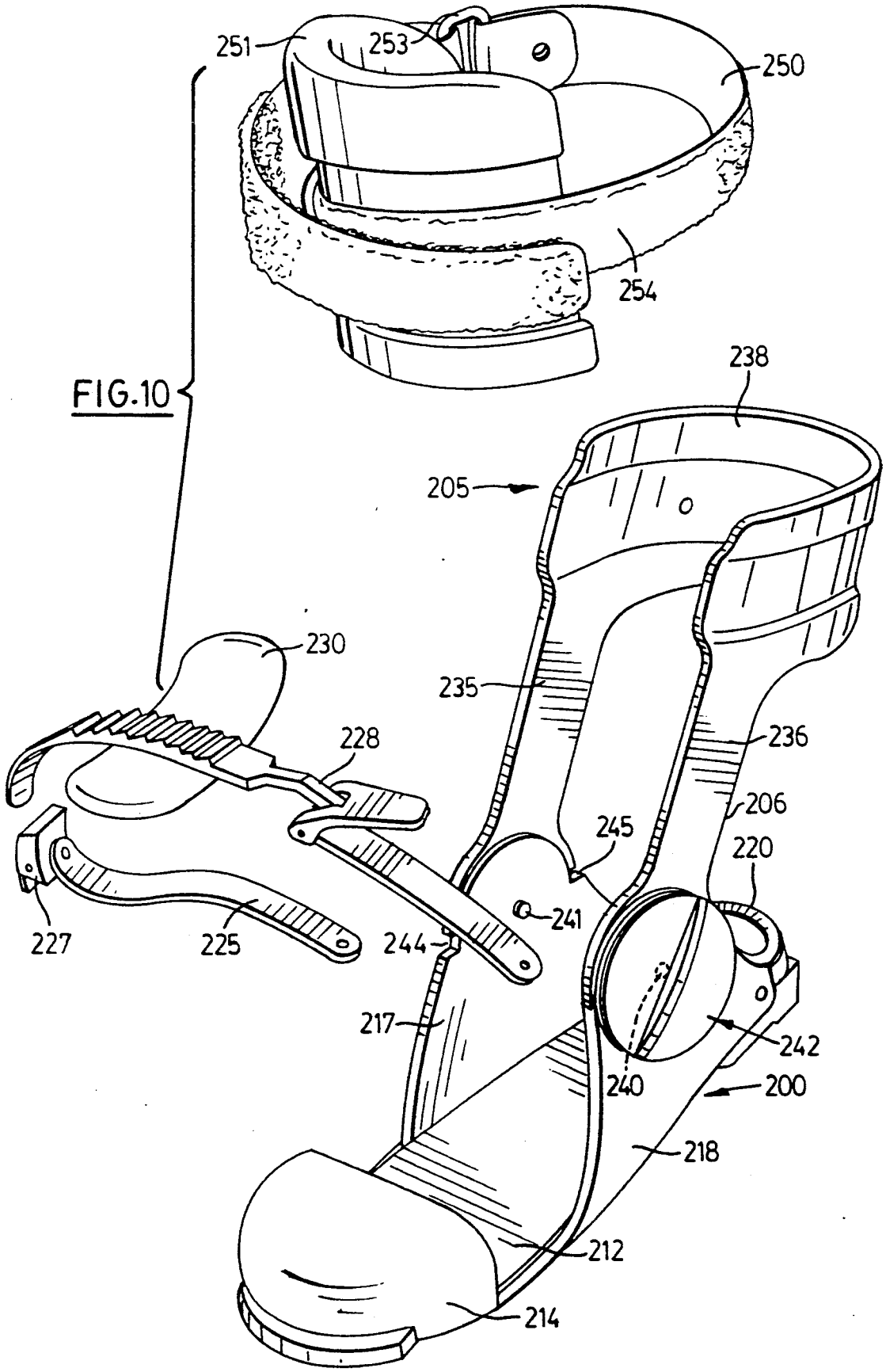
FIG. 10 is a perspective exploded view of a further embodiment of the invention.
Figure 11:
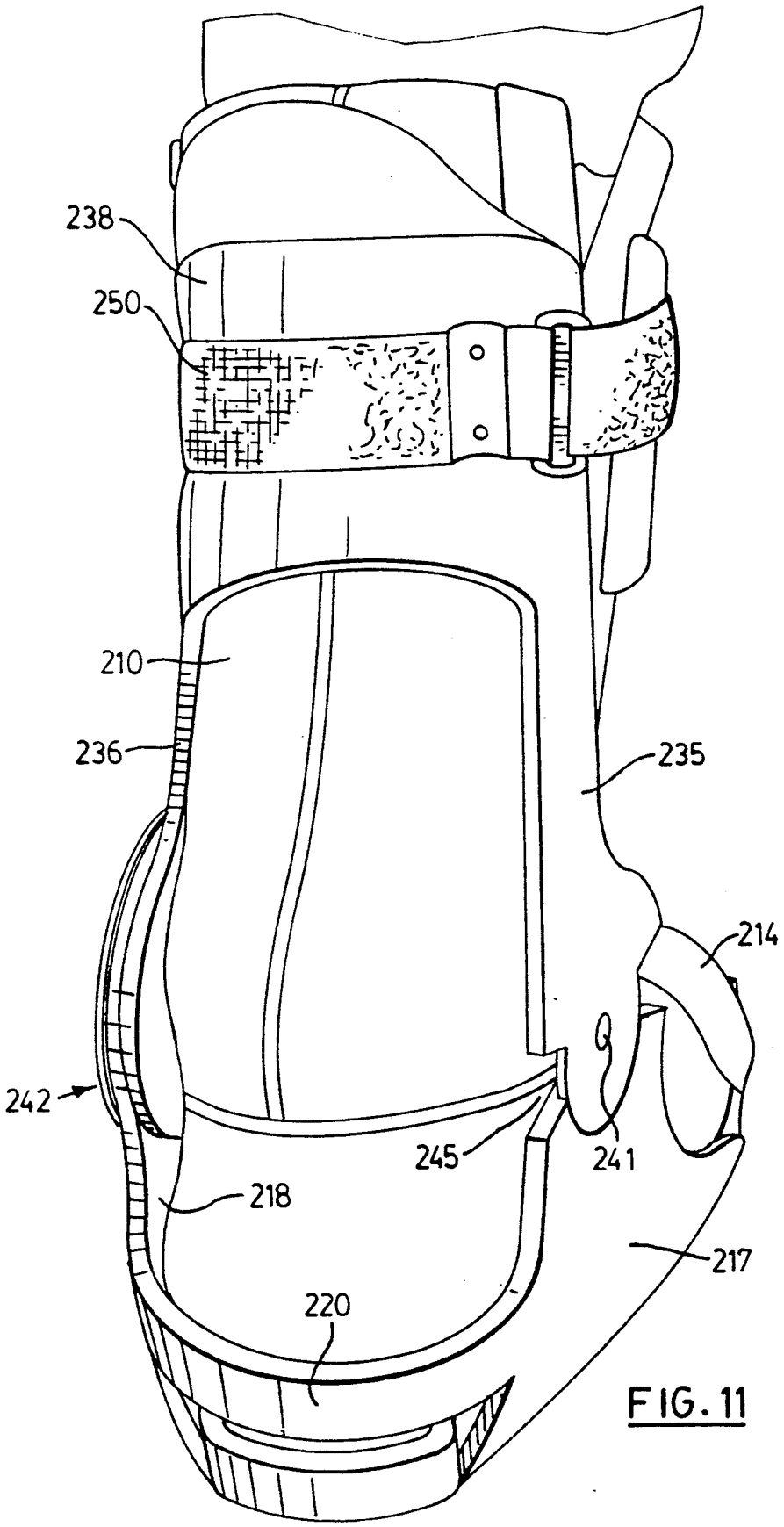
FIG. 11 is a rear perspective view of the device shown in FIG. 10 with a boot inserted.

A further embodiment of the invention is shown in FIGS. 10 and 11, wherein the boot brace 200 has a lateral leg support means 205 which has an upper spring biased portion 206 engageable with the skier's calf rather than with his shin as in the embodiments described above.

The boot brace 200 of this embodiment has the advantage of being usable with a standard flexible felt lined winter boot 210 such as a SOREL ® boot made by Kaufman Footwear. The boot 210 is inserted into the brace 200 in a more convenient fashion forward of the lateral leg support means 205, than is the case with the above described embodiments.

The boot brace 200 has a sole plate 212 shaped to fit into a standard downhill ski binding. The sole plate 212 is made of a rigid material which may be a thermoplastic or composite material. The forefoot receiving means is preferably a toe cap 214 which is attached to the sole plate 212 and preferably is formed integrally with the sole plate 212. The toe cap 214 is shaped to receive the toe portion of the boot 210 and hold the toe portion in place when the boot 210 is secured in the boot brace 200.

Inner and outer lower lateral support members 217 and 218 extend upwardly from the sole plate 212 to the ankle region of the boot 210. Again, it is preferred to have the lower lateral support members 217 and 218 formed integrally with the sole plate 212. A heel guard 220 wraps around the heel of the boot 210 situated in the boot brace 200 from one lower lateral support member to the other. Preferably, the heel guard 220 is formed integrally with the lower lateral support members 217 and 218.

Preferably, the entire lower portion of the boot brace 200, comprising the sole plate 212, toe cap 214, lower lateral support members 217 and 218, and the heel guard 220, is formed of a strong rigid thermoplastic or composite material which can be molded or formed as one piece. The structure of the lower portion of the boot brace 200 provides a close fit about the foot of the boot 210, thereby giving the skier a feeling of support akin to that of a conventional ski boot.

The boot 210 is not held strongly in place against the sole plate 212, but rather is restrained in the lower portion of the boot brace 200 by means of a strap 225 extending from near the heel area of the brace 200 to be fastenable over the vamp of the boot 210. While the fastening means for the strap 225 may be any of several types, a buckle 227 and over centre latch 228 arrangement as described above is preferred. A pad 230 may be inserted between the strap 225 and the boot 210 for comfort.

The boot brace 200 of this embodiment has no positive heel hold down means. This omission as compared to prior embodiments has the advantage of allowing the boot brace 200 to be used with standard boots 210 rather than with boots having adaptions solely for the purpose of mating with the structure of the boot brace. In this embodiment, the boot 210 is restrained against the sole plate 212 by the toe cap 214 and forefoot strap 225; however, the boot 210 is only urged against the sole plate 212 by this boot brace structure, so there may be some slight movement of the boot 210 away from the sole plate 212 during skiing. In this arrangement, the foot moves with the boot 210 rather than relative skier's foot moves with the boot 210 rather than relative to it as is the case with the standard ski boots and the previously described embodiments having a firm securement of the boot in the brace.

The boot brace 200 has an upper lateral support means 206, comprising inner and outer struts 235 and 236 joined at their upper ends by a curved calf piece 238. The upper lateral support means 206 is pivotally joined to the lower lateral support members 217 and 218 about the ankle region of the boot 210 at the pivot points 240 and 241. As with previously described embodiments, the pivotal rotation of upper support means 206 is spring biased at the pivotal ankle region. Preferably, the spring biasing means is an elastomeric spring device 242 as shown in FIGS. 3–6 and described above. Accordingly, the range of pivotal movement of the upper support means 206 relative to the lower support members 217 and 218 is limited by the range of movement allowed by the elastomeric spring device 242.

It has been found to be preferable also to limit the range of rotation about the non-biased pivot connection between the upper and lower support members. As shown in FIGS. 10 and 11, the spring bias means are preferably located at the pivot 240 for the outer lateral support of the boot brace 200, i.e., between the lower member 218 and the upper strut 236. The corresponding inner lateral supports 217 and 235 are formed with opposing surfaces which provide front and rear notched areas 244 and 245 when joined, thereby defining the limits of forward and rearward movement at that pivotal connection 241. By coordinating the degree of rotation allowed about each pivotal attachment, the upper lateral support 206 is stabilized against twisting when the elastomeric spring device 242 is pivoted to its limit.

The upper lateral support 206 is secured about the leg of the skier by a strap 250 having a shin pad 251. The strap 250 is preferably of the type described above having a rectangular ring 253 and VELCRO® means 254 for securing the strap end. The curved calf piece 238 does not require padding since the felt liner of the boot 210 is sufficient for this purpose.

The use of the embodiment shown in FIGS. 10 and 11 is thought to be the most convenient of the embodiments described. The skier steps into the boot brace 200 as if putting on a boot, toe first into the toe cap 214 followed by stepping down on the heel so that the sole of the boot 210 is against the sole plate 212. The forefoot restraining strap 225 is buckled, but the over centre latch 228 may not be closed until just before the ski run is to begin. The upper lateral support 206 is secured by means of the strap 250, and the ski boot assembly is then ready for use.

From the foregoing, it will be appreciated that the invention provides a ski boot assembly having structure which gives the skier the control and feel of a conventional ski boot but which incorporates a flexible boot so that the skier can remove his skis and boot brace and walk normally and comfortably. While a preferred embodiment of the invention has been described, the ambit of patent protection sought is not intended to be limited by such description, but is defined particularly in the following claims.

We claim:

1. A downhill ski boot assembly, comprising:

a boot made of flexible materials enabling the wearer to walk normally, the boot having a sole, a toe, a heel, an ankle region, and a leg shaft; and a boot brace made of a rigid material for receiving and holding the boot within it, said boot brace having a sole plate adapted to be insertable into a downhill ski binding, and a boot receiving structure, comprising:

a forefoot receiving means attached to the sole plate for receiving the toe of the boot;

inner and outer lower lateral support members extending upwardly from the sole plate;

a heel guard extending from one lower lateral support member to the other;

boot restraining means for urging the sole of the boot against the sole plate, said restraining means being attached to the lower lateral support members;

inner and outer upper lateral support means engageable with the leg shaft of the boot, said upper support means being attached pivotally to the lower lateral support members about the ankle region of the boot;

spring bias means at said pivotal ankle region adjacent the pivot to provide a gradient of resistance to the forward rotation of the upper lateral support means about the pivotal ankle region; and securement means for securing the upper lateral support means about the leg shaft of the boot.

2. A downhill ski boot assembly as claimed in claim 1, wherein the forefoot receiving means is a toe cap.

3. A downhill ski boot assembly as claimed in claim 1, wherein the sole plate, forefoot receiving means, lower lateral support members and heel guard are all integrally formed as a single unit.

4. A downhill ski boot assembly as claimed in claim 1, wherein the lower lateral support members extend upwardly to the ankle region of the boot.

5. A downhill ski boot assembly as claimed in claim 1, wherein the boot restraining means is a strap extending over the vamp of the boot, said strap having two pieces joinable by a buckle.

6. A downhill ski boot assembly as claimed in claim 5, wherein the strap has an over centre latch to tighten and loosen the buckled strap.

7. A downhill ski boot assembly as claimed in claim 1, wherein the inner and outer upper lateral support means comprises inner and outer lateral struts joined at their top ends by a curved calf engaging piece.

8. A downhill ski boot assembly as claimed in claim 1, wherein the spring bias means is provided at the outer pivotal attachment of the upper lateral support means to the lower lateral support members.

9. A downhill ski boot assembly as claimed in claim 1, wherein the spring bias means comprises: a cassette having an outer frame, elastic members, and a movable insert, the outer frame defining a plurality of spaces shaped to receive an elastic member and a part of the insert; a cassette holder fixedly attached to a lateral support portion, the holder allowing insertion and removal of the cassette but preventing rotation of it; and an actuator for the insert fixedly attached to the other lateral support portion, the assembled spring biased pivot being held together by retaining means.

10. A downhill ski boot assembly as claimed in claim 9, wherein the elastic members are made of a rubber material, the cassette holder is attached to the lower support member, and the retaining means is a cap screw which coacts with a threaded core of the actuator.

11. A downhill ski boot assembly as claimed in claim 1, wherein the spring bias means is a rubber spring.

12. A downhill ski boot assembly as claimed in claim 1, wherein the spring bias means comprises inner and outer parts which coact with at least one elastomeric member positioned between said inner and outer parts to produce an elastomeric force from said elastomeric member upon rotation of the inner and outer parts relative to one another.

13. A downhill ski boot assembly as claimed in claim 1, wherein the securement means for the upper lateral support means is a strap having a shin pad and adjustable closure means.

14. A downhill ski boot assembly as claimed in claim 8, wherein the inner pivotal attachment of the upper lateral support means to the lower lateral support members are provided with opposing surfaces defining front and rear notched areas about the pivot, said opposing surfaces setting the limits of forward and rearward movement about the pivot.

* * * * *